US011747105B1

(12) United States Patent
Tripp et al.

(10) Patent No.: US 11,747,105 B1
(45) Date of Patent: Sep. 5, 2023

(54) BORE CLEANING TOOL

(71) Applicant: New Revo Brand Group LLC, Plymouth, MN (US)

(72) Inventors: Howard Tripp, Plymouth, MN (US); Daniel Zaleskas, St. Louis Park, MN (US)

(73) Assignee: NEW REVO BRAND GROUP, LLC, Plymouth, MN (US)

( * ) Notice: Subject to any disclaimer, the term of this patent is extended or adjusted under 35 U.S.C. 154(b) by 0 days.

(21) Appl. No.: 17/824,060

(22) Filed: May 25, 2022

(51) Int. Cl.
*F41A 29/02* (2006.01)

(52) U.S. Cl.
CPC ..... *F41A 29/02* (2013.01)

(58) Field of Classification Search
CPC ..... F41A 29/00; F41A 29/02
See application file for complete search history.

(56) References Cited

U.S. PATENT DOCUMENTS 51,362 A * 12/1865 Spiegle ..... F41A 29/02 15/104.16
175,628 A * 4/1876 Schulte ..... F41A 29/02 343/726
190,123 A * 5/1877 Budd ..... F41A 29/02 42/95
464,843 A * 12/1891 Bagger ..... F41A 29/02 42/95
690,393 A * 1/1902 Bishop ..... F41A 29/02 15/104.18
1,213,383 A * 1/1917 Kiessig ..... F41A 29/02 15/104.165
1,490,038 A * 4/1924 Smith ..... F41A 29/02 42/95
1,532,222 A * 4/1925 Belding ..... F41A 29/02 42/95
1,546,475 A * 7/1925 Cook ..... F41A 29/02 42/95

(Continued)

FOREIGN PATENT DOCUMENTS

CN 101238354 B 10/2011
GB 187545 A 10/1922
GB 245311 A 1/1926

OTHER PUBLICATIONS

Bore Tech, Bore Tech Proof Positive Patch Jag, 308 Calorie, https://www.amazon.com/Bore-Tech-Proof-Positive-Calorie/dp/B007W1WJZO, accessed Mar. 25, 2021.

(Continued)

*Primary Examiner* — Derrick R Morgan
(74) *Attorney, Agent, or Firm* — GRUMBLES LAW PLLC; Brittany Haanan

(57) ABSTRACT

A bore cleaning tool comprised of a jag having a central body, a spiked tip near a first end of the central body, and a threaded portion near a second end of the central body. The central body may have a plurality of shallow reservoirs and deep reservoirs. The plurality of shallow and deep reservoirs can repeatedly alternate. Each of the shallow reservoirs can include a pair of flanking ridges with a corresponding central portion, and each pair of flanking ridges can have a larger radius than a radius of the corresponding central portion. A patch can be connected to the spiked tip so the bore cleaning tool can be used for cleaning the bore of a firearm barrel.

19 Claims, 3 Drawing Sheets

(56) References Cited

U.S. PATENT DOCUMENTS 1,745,575 A * 2/1930 Hooker ..... F41A 29/02 15/104.18
2,805,434 A * 9/1957 Hopkins ..... F41A 29/02 42/95
2,862,218 A * 12/1958 Krone ..... F41A 29/02 15/210.1
3,137,957 A 6/1964 Ingalls
3,205,518 A 9/1965 Romaine
3,682,556 A 8/1972 Hanson
3,738,101 A 6/1973 Simon
3,739,420 A 6/1973 Kafkis
4,407,086 A 10/1983 Hasselmann
4,499,625 A * 2/1985 Bottomley ..... F41A 29/02 42/95
4,967,439 A 11/1990 LaLonde
5,127,179 A * 7/1992 Marsh ..... F41C 9/085 42/95
5,317,827 A * 6/1994 Jaremco ..... F41A 25/02 42/95
5,983,550 A 11/1999 Skaar
6,085,376 A * 7/2000 Antal ..... B08B 9/0557 15/104.16
6,691,446 B2 * 2/2004 Graves ..... F41A 29/02 42/95
7,341,533 B2 3/2008 Wang et al.
7,481,015 B2 1/2009 Mays
8,196,330 B2 6/2012 Smith
D674,873 S * 1/2013 Rogers ..... D22/199
8,371,057 B2 2/2013 Coffield, III
8,572,883 B2 11/2013 Markle
8,661,724 B2 * 3/2014 Crawford ..... F41A 29/04 42/95
8,677,671 B2 3/2014 Smith
8,793,918 B2 * 8/2014 Rogers ..... F41A 29/02 42/95
D733,245 S 6/2015 Wickser, Jr.
9,291,419 B2 3/2016 Shipman
RE46,065 E * 7/2016 Crawford ..... F41A 29/04
9,995,554 B2 6/2018 Thompson
9,995,555 B2 6/2018 Rohlin et al.
10,478,957 B1 * 11/2019 Keele ..... B25B 15/005
10,677,556 B2 * 6/2020 Rambo ..... F41A 29/02
2002/0056219 A1 5/2002 Solberg et al.
2003/0233779 A1 * 12/2003 Graves ..... F41A 29/02 42/90
2006/0147247 A1 7/2006 Whipple
2006/0162223 A1 7/2006 Whipple
2007/0261288 A1 11/2007 Perry et al.
2007/0266610 A1 * 11/2007 Coffield, III ..... F41A 29/02 42/95
2007/0294931 A1 12/2007 Kettles
2009/0283115 A1 * 11/2009 Dentico ..... F41A 29/00 134/22.1
2011/0107646 A1 * 5/2011 Anderson ..... F41A 29/02 42/95
2013/0047484 A1 2/2013 Wickser, Jr.
2013/0055615 A1 * 3/2013 Krieger ..... F41A 29/02 42/95
2013/0125925 A1 * 5/2013 Markle ..... F41A 29/02 42/95
2013/0333265 A1 * 12/2013 Crawford ..... F41A 29/04 42/95
2014/0124002 A1 * 5/2014 Williams ..... A61B 1/122 134/8
2015/0153129 A1 * 6/2015 Marvin ..... F41A 29/02 42/95
2015/0184969 A1 * 7/2015 Marvin ..... F41A 29/02 42/95
2016/0258705 A1 * 9/2016 Whitworth ..... F41A 29/02
2016/0346814 A1 * 12/2016 Good ..... F16L 55/40
2017/0176126 A1 * 6/2017 Thompson ..... B08B 1/003
2017/0336166 A1 * 11/2017 Rohlin ..... F41A 29/02
2019/0003797 A1 * 1/2019 Marvin ..... B08B 9/0436
2020/0103198 A1 4/2020 Williams et al.

OTHER PUBLICATIONS

TCS Manufacturing, The Custom Shop Bore Cleaning Jag 12ga, https://www.sportsridge.com/products/tcs-the-custom-shop-bore...PI1n0mUcqapUamzKFZnRIpB2uWNfKtNywDwdND_pbLBIIohoCWL0QAvD_BwE, accessed Mar. 25, 2021.
Tipton, Ultra Jag, https://www.cabelas.com/shop/en/tipton-ultra-jag?ds_e=GOOGLE&..._floETK8WIXK4RO997m-_JtzH9baHT5qphoCSTcQAvD_BwE&gclsrc=aw.ds, accessed Mar. 25, 2021.

* cited by examiner

BORE CLEANING TOOL

FIELD OF THE INVENTION

This disclosure relates to a bore cleaning tool. More specifically, it relates to a cleaning jag for insertion into the bore of a firearm, the cleaning jag being configured to pair with a patch and used to clean firearm bores.

BACKGROUND OF THE INVENTION

After use and throughout their lives, firearm bores are affected by debris, moisture, rust, copper, carbon, and gunpowder residue. Therefore, gun bores need to be cleaned so they can function properly and so they do not rust and decay. Jag and patch systems are known cleaning tools that are used to clean such unwanted materials from firearm bores. However, currently existing jag and patch systems have shortcomings such as short jags and square or circular patches that bunch up when inserted into the bore. These shortcomings result in a user having to complete multiple pass-throughs with the jag and patch system and, typically, also result in having to use several patches in order to get a firearm bore properly cleaned. Therefore, a more efficient jag and patch system is needed that can maximize the effectiveness of each pass-through.

SUMMARY OF THE INVENTION

The present disclosure relates to cleaning jag for insertion into the bore of a firearm, the cleaning jag being configured to pair with a patch and used to clean firearm bores. In an illustrative but non-limiting example, the disclosure provides a bore cleaning tool that can include a jag having a central body with a plurality of shallow reservoirs and deep reservoirs, a spiked tip near a first end of the central body, and a threaded portion near a second end of the central body. The plurality of shallow and deep reservoirs can repeatedly alternate, and each of the shallow reservoirs can include a pair of flanking ridges with a corresponding central portion, and each pair of flanking ridges can have a larger radius than a radius of the corresponding central portion.

In some cases, the deep reservoirs can each have identical lengths such that the shallow reservoirs are spaced equidistantly apart. In some cases, the shallow reservoirs each have identical lengths such that the deep reservoirs are spaced equidistantly apart.

In some cases, the plurality of shallow reservoirs and deep reservoirs can be approximately cylindrical, the radius of each pair of flanking ridges can be uniform, the radius of each of the plurality of corresponding central portions can be uniform, and the radius of each of the plurality of deep reservoirs can be uniform. Further, the radius of each of the plurality of corresponding central portions can be larger than the radius of each of the plurality of deep reservoirs. The central body can include at least 7 shallow reservoirs and at least 7 deep reservoirs. Further, the central body can include 14 shallow reservoirs and 15 deep reservoirs.

In some cases, the apparatus can be connectable to an elongate rod at the threaded portion. Further, the jag can be further comprised of a stopper positioned between the second end of the central body and the threaded portion. The stopper can have a larger radius than a radius of the threaded portion, and the threaded portion can have a radius that is approximately the same as a radius of the plurality of deep reservoirs.

In some cases, the bore cleaning tool further includes a patch connected to the spiked tip. A center of the patch can be connected to the spiked tip leaving equal portions of the patch on opposing sides of the spiked tip, wherein the equal portions each have a length that is at least as long as the central body and a width that is approximately half the circumference of the flanking ridges. The patch can be quilted and can include micro-pore fibers.

In some cases, the spiked tip cam be comprised of a conical point and a cylindrical length, and the cylindrical length can have a series of ridges and valleys between the conical point and the central body. Further, the jag can include a smooth, uniform cylinder between the spiked tip and the central body, and the smooth, uniform cylinder can have a similar radius to the radius of the flanking ridges of the shallow reservoirs. Additionally, the series of ridges and valleys can be located between the spiked tip and the smooth, uniform cylinder.

In some cases, the firearm cleaning apparatus can be made of a single material. For example, the firearm cleaning apparatus can be nickel plated. More specifically, the firearm cleaning apparatus can be electroplated nickel.

In another illustrative but non-limiting example, the disclosure provides a bore cleaning tool for cleaning the bore of a firearm barrel, the tool including a jag having a spiked tip near a first end, a central body having a plurality of cylindrical shallow reservoirs and deep reservoirs, a smooth, uniform cylinder between the spiked tip and the central body, and a threaded portion near a second end that is connectable to an elongate rod. The plurality of shallow and deep reservoirs can repeatedly alternate. The deep reservoirs can each have identical lengths such that the shallow reservoirs are spaced equidistantly from one another. Each of the shallow reservoirs can include a pair of flanking ridges with a corresponding central portion, and each of the pairs of flanking ridges have a larger radius than the corresponding central portion. The jag can be nickel plated. In some cases, the bore cleaning tool further includes a quilted patch that is centered at the spiked tip and that covers the central body.

DETAILED DESCRIPTION

Figure 1:
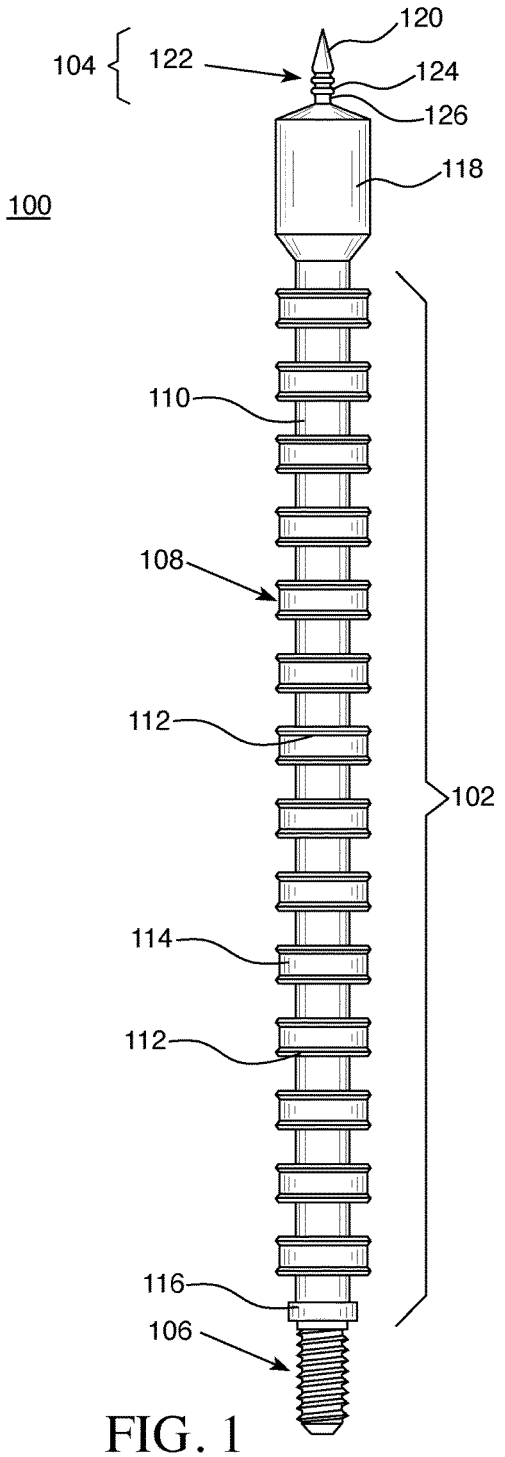
FIG. 1 is a side view of a jag of a bore cleaning tool according to a first embodiment of the present disclosure.

The present disclosure relates to a bore cleaning tool that can be used to clean the interior of the barrel (i.e., the bore) of a gun. Various embodiments of the bore cleaning tool will be described in detail with reference to the drawings, wherein like reference numerals represent like parts and assemblies throughout the several views. Reference to various embodiments does not limit the scope of the bore cleaning tool disclosed herein. Additionally, any examples set forth in this specification are not intended to be limiting and merely set forth some of the many possible embodiments for the bore cleaning tool. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

Some embodiments of the bore cleaning tool disclosed herein include features that are best suited for cleaning the interior surfaces of a firearm barrel, otherwise known as the bore of a firearm. Most modern rifle and pistol bores have rifling, wherein the bore is comprised of lands and grooves. The grooves are cutout, helical spaces that extend down the bore. The lands are the ridges in between the grooves. The structure and configuration of the bore cleaning tool enables both grooves and lands to be cleaned simultaneously.

More specifically, the bore cleaning tool includes a jag with a central body having alternating shallow and deep reservoirs, a spiked tip, and a threaded end portion. A corresponding patch can be attached to the spiked tip of the jag such that the patch completely covers the central body of the jaw. Preferably, the diameter of the widest part of the jag is sized to correspond to the bore and little to no portions of the patch overlap with each other. Therefore, when the bore cleaning tool is inserted into the barrel, the user maximizes the surface area of the tool that makes contact with the bore. In other words, if the patch portions had greater amounts of overlap and, therefore, bunching, then the nonoverlapping portions of the patch may be prevented from making good, if any, contact with the bore. In the current disclosure, this design flaw is eliminated by removing bunching.

Figure 2:
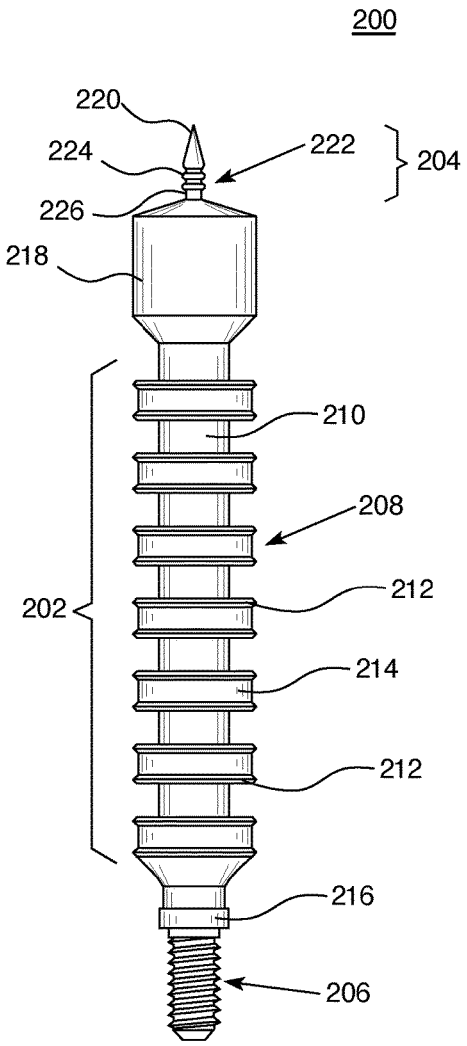
FIG. 2 is a side view of a jag of a bore cleaning tool according to a second embodiment of the present disclosure.
Figure 3:
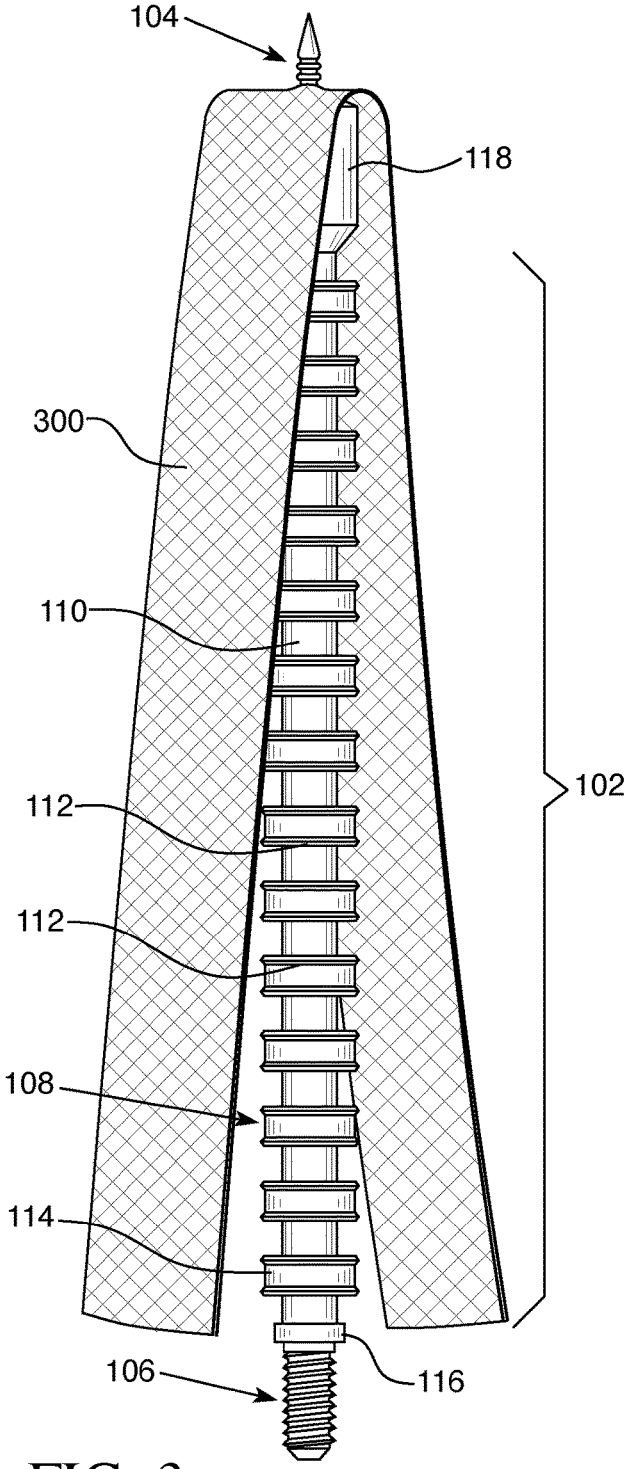
FIG. 3 is a side view of a jag and patch of a bore cleaning tool according to the first embodiment of the present disclosure.
Figure 4:
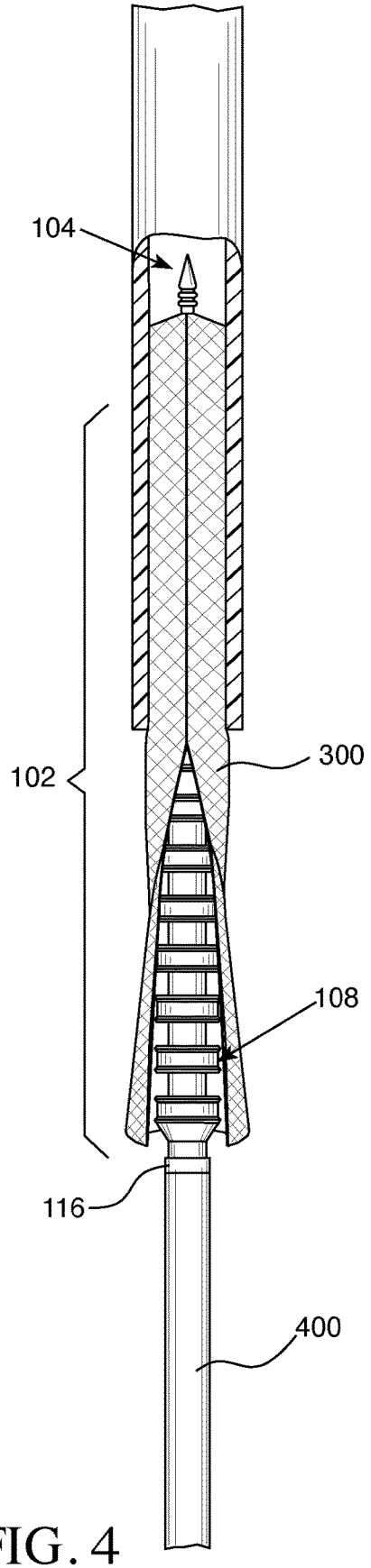
FIG. 4 is a side view of a jag and patch of a bore cleaning tool in use according to the first embodiment of the present disclosure.
Figure 5:
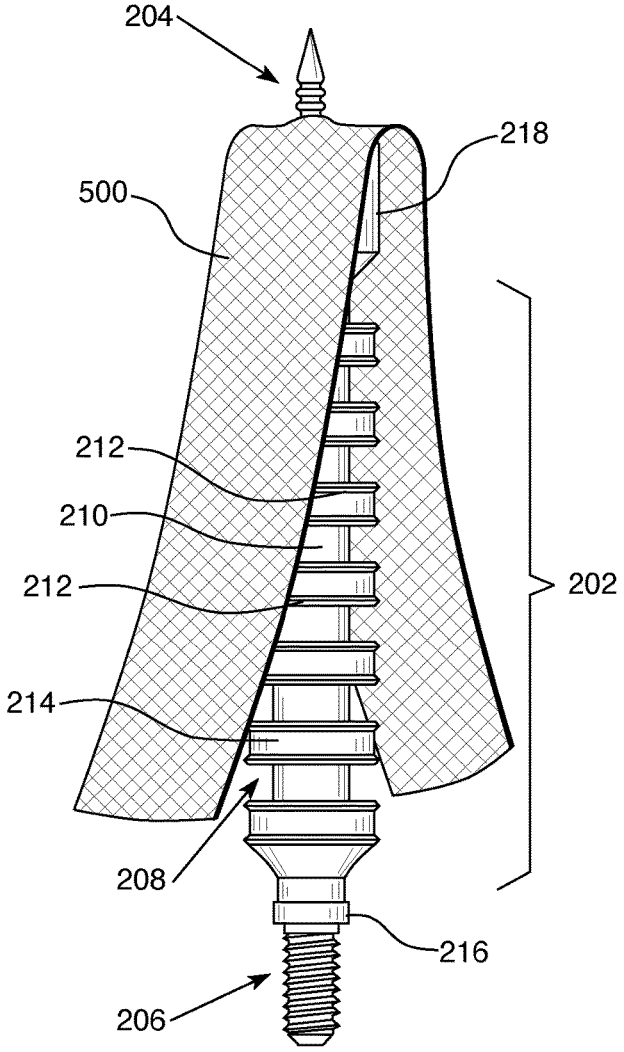
FIG. 5 is a side view of a jag and patch of a bore cleaning tool according to the second embodiment of the present disclosure.
Figure 6:
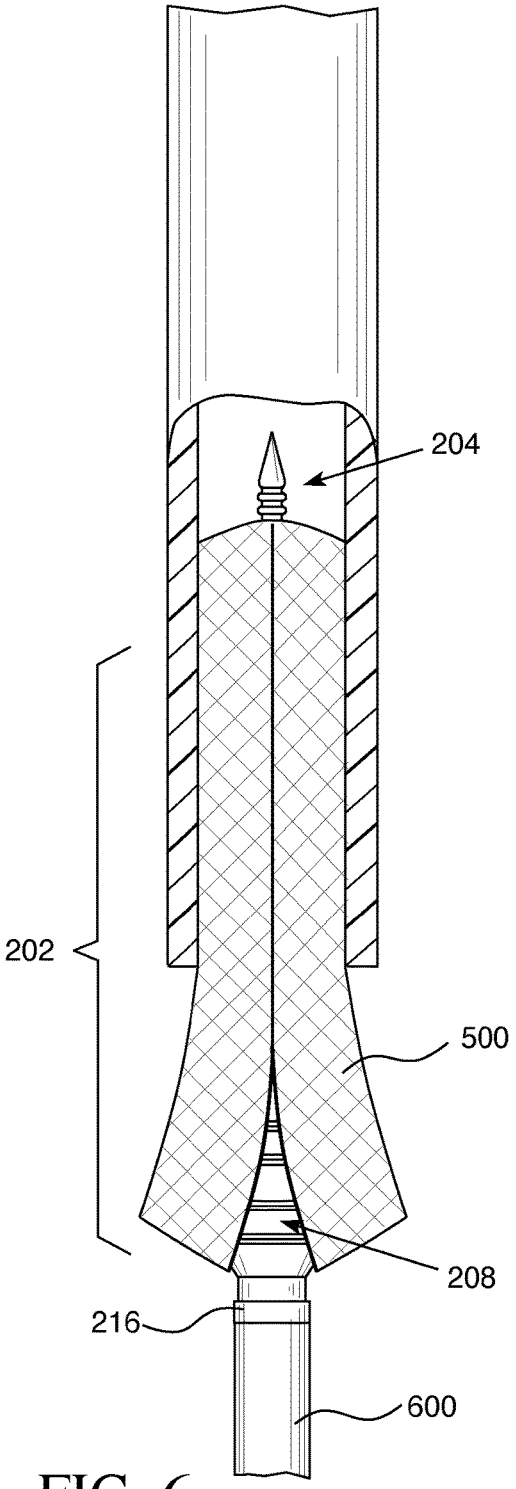
FIG. 6 is a side view of a jag and patch of a bore cleaning tool in use according to the second embodiment of the present disclosure.

FIGS. 1-6 illustrate various views of an example of a bore cleaning tool according to the present disclosure. FIG. 1 is a side view of the jag of a first embodiment. FIG. 2 is a side view of the jag of a second embodiment. FIG. 3 is a side view of the jag and patch of the first embodiment. FIG. 4 is a side view of the first embodiment inserted into a bore. FIG. 5 is a side view of the jag and patch of the second embodiment. FIG. 6 is a side view of the second embodiment inserted into a bore.

Generally, the jag of the bore cleaning tool is roughly cylindrical with a long length compared to its diameter, and the patch of the bore cleaning tool is approximately rectangular with a long length compared to its width. In some embodiments, the jag can have a central body comprised of a plurality of shallow and deep reservoirs, a spiked tip near a first end of the central body, and a threaded portion near a second end of the central body. The jag can be comprised entirely of a single, rigid material (for example, nickel) or type of material (for example, metals) or it can be comprised of a first material that is then plated by a second material (for example, nickel plated). If plated, the plating can be accomplished via electroplating (for example, electroplated nickel). The jag may be absent of any flexible or compressible materials or components such as o-rings, rubber parts, etc. The patch of the cleaning tool can be a patch that connects to the spiked tip leaving equal portions of the patch on opposing sides of the spiked tip. The patch can be a made from natural or synthetic material.

As illustrated in FIG. 1, jag 100 can be comprised of central body 102, spiked tip 104, and threaded portion 106. Central body 102 can further be comprised of shallow reservoirs 108 and deep reservoirs 110 that repeatedly alternate along the central body. Further, each shallow reservoir 108 can include a pair of flanking ridges 112 having a corresponding central portion 114, and each pair of flanking ridges can have a larger radius than the radius of the corresponding central portion. These same features can be present in a second embodiment of the jag. More specifically, jag 200 can also be comprised of central body 202 having alternating shallow reservoirs 208 and deep reservoirs 210, spiked tip 204, and threaded portion 206, wherein each of the shallow reservoirs can include a pair of flanking ridges 212 having a corresponding central portion 214.

As mentioned above, central body 102, 202 is approximately cylindrical and can include alternating cylindrical shallow and deep reservoirs along its length. For example, central body 102 may include a predetermined number of shallow reservoirs 108 (for example, 14) and a predetermined number of deep reservoirs 110 that is one more than the number of shallow reservoirs (for example, 15) such that the reservoirs start on one end with a deep reservoir and end on the opposite end with a deep reservoir, as illustrated in FIG. 1. Alternatively, central body 202 may include the same number of shallow reservoirs 208 and deep reservoirs 210 (for example, 7 of each, as illustrated in FIG. 2) such that the reservoirs start on one end with a deep reservoir (for example, the end closest to spiked tip 204) and end on the opposite end with a shallow reservoir (for example, the end closest to threaded portion 206). In another embodiment, the central body may include a predetermined number of shallow reservoirs (for example, 15) and a predetermined number of deep reservoirs that is one less than the number of shallow reservoirs (for example, 14) such that the reservoirs start on one end with a shallow reservoir and end on the opposite end with a shallow reservoir.

As illustrated in the figures, the shallow and deep reservoirs can effectively be cylindrical rings that have different circumferences and radii. For example, deep reservoirs 110, 210 may have a smaller circumference and radius compared to the circumference and radius of shallow reservoirs 108, 208 or portions of the shallow reservoirs (for example, flanking ridges 112, 212 and/or central portions 114, 214). In some embodiments, all shallow reservoirs 108, 208 along central body 102, 202 are uniformly sized, as illustrated in FIGS. 1 and 2. In other embodiments, some shallow reservoirs may have slightly different circumferences, radii, and/or heights than other shallow reservoirs. Similarly, each deep reservoir 110, 210 along central body 102, 202 may be uniformly sized, as illustrated in FIGS. 1 and 2, or they may have varying circumferences, radii, and/or heights. Further, each deep reservoir can be uniform and smooth throughout while each shallow reservoir can have outer ridges and a smooth, central body. Regardless of size, the shallow and deep reservoirs can be centered along axis Y.

In order to more effectively use solvents when cleaning a bore, both shallow and deep reservoirs can be structured and configured to contain solvent. More specifically, both shallow reservoirs 108, 208 and deep reservoirs 110, 210 can be concave or flat (instead of convex) so that the solvent does not run out or away from these portions of central body 102, 202. Additionally, as mentioned above, each shallow reservoir 108 can include a pair of flanking ridges 112, 212, which are disc-like edges on the ends of each shallow reservoir. The region between each pair of flanking ridges 112, 212 can be central portion 114, 214, which can have a smaller circumference and radius compared to the circumference and radius of the flanking ridges. In such a way, any solvent used during bore cleaning can be retained within each shallow reservoir 108, 208. Additionally, deep reservoirs can be positioned between shallow reservoirs and therefore, the shallow reservoirs can effectively act as flanking ridges and the deep reservoir can be analogous to the central portion of the shallow reservoir.

In some embodiments, each pair of flanking ridges 112, 212 can have uniform radii such that the distance between the outermost point of each flanking ridge in a pair and the surface of central portion 114, 214 is the same. As illustrated in FIGS. 1 and 2, the radius of each pair of flanking ridges can be uniform not only within the pair itself, but also between pairs. However, the pairs of flanking ridges 112, 212 may have variable radii such that the distance between the central channel and the outermost point of one pair of flanking ridges is different (either smaller or larger) than the distance between the central channel and the outermost point of a second pair of flanking ridges.

Similarly, the radius of each of the corresponding central portions can be uniform throughout central body 102, 202. Alternatively, the central portions can have varying radii. In some cases, there may be a pattern throughout (for example, a version with alternating small and large radial central portions or a version where the radius of each central portion gets larger toward one end of central body 102, 202).

As with the radii of shallow reservoirs 108, 208 and as mentioned above, the radii of deep reservoirs 110, 210 can be uniform, as illustrated in FIGS. 1 and 2, or they can be variable. If variable, they may alternate between smaller and larger radii and they may vary by wider and shorter lengths. Further, they may vary in a pattern such as alternating small and large radii, increasing radii from one end of central body 102 to the opposite end, or any other pattern.

In some embodiments, the radius of each central portion 114, 214 can be larger than the radius of each deep reservoir 110, 210, regardless of uniformity among or between such elements. For example, all central portions 114, 214 can have a first radius, all deep reservoirs 110, 210 can have a second radius, and the first radius can be larger than the second radius. Alternatively, central portions 114, 214 may have a plurality of different radii (for example, the group of central portions may be comprised of central portions having a large radius and central portions having a small radius, and those two sized central portions may alternate from one end to the other) and those central portions may all have larger radii than any radii of deep reservoirs 110, 210, which may all be uniform or they be comprised of different sizes (similar to that described above for the central portions). Similarly, the radius of each central portion 114, 214 can be smaller than the radius of each deep reservoir 110, 210, regardless of uniformity among or between such elements. In further embodiments the radius of all central portions 114, 214 and deep reservoirs 110, 210 can be the same as each other.

In some embodiments, deep reservoirs 110, 210 can have identical lengths along Y-axis such that shallow reservoirs 108, 208 are spaced equidistantly from one another. It is possible for shallow reservoirs 108, 208, therefore, to have different lengths themselves but be equally spaced apart. Similarly, in some embodiments, shallow reservoirs 108, 208 can have identical lengths such that deep reservoirs 110, 210 are spaced equidistantly from one another. As with the prior example, it is then possible for deep reservoirs 110, 210 to have different lengths themselves but be equally spaced apart.

As mentioned above, in addition to central body 102, jag 100 can include spiked tip 104 and threaded portion 106. Therefore, central body 102 can have two ends, wherein spiked tip 104 is located on a first end, and threaded portion 106 is located on a second end. Spiked tip 104 and threaded portion 106 may connect directly to central body 102 or, alternatively, either or both may attach to the central body via an intermediary component such as stopper 116 or cylinder 118. Similarly, these same features can be present in the second embodiment of the jag. More specifically, jag 200 can include central body 202 with two ends, wherein spiked tip 204 is located on a first end and threaded portion 206 is located on a second end, and wherein either or both of the spiked tip and threaded portion may attach to the central body via an intermediary component such as stopper 216 or cylinder 218.

In some embodiments, spiked tip 104, 204 can include conical point 120, 220 and cylindrical length 122, 222 that further directly or indirectly attaches to central body 102, 202. More specifically, a portion of spiked tip 104, 204, such as cylindrical length 122, 222, can be comprised of a series of ridges 124, 224 and valleys 126, 226 located between conical point 120, 220 and a portion of central body 102, 202 (for example, cylinder 118, 218). In some cases, cylindrical length 122, 222 includes two or more ridges 124, 224 and three or more valleys 126, 226 such that a bottom portion of conical point 120, 220 leads into a first valley and a third valley then leads into the next portion of jag 100, 200, such as, but not limited to, central body 102, 202 or cylinder 118, 218, as illustrated in FIGS. 1 and 2. The bottom portion of conical point 120, 220 may have a similar radius to ridges 124, 224, and the radius of valleys 126, 226 may be smaller than the radius of the ridges and the conical point.

As mentioned above, jag 100, 200 may include cylinder 118, 218, which can be a smooth, uniform cylinder that is located between spiked tip 104, 204 and central body 102, 202. Cylinder 118, 218 can have a relatively uniform main body such that the edges are straight and do not expand or contract. The radius of the main body of cylinder 118, 218 can be similar to the radius of flanking ridges 112, 212 of shallow reservoirs 108, 208. Further, cylinder 118, 218 can have a smooth surface. Therefore, when jag 100, 200 is inserted into a bore of a firearm, the portions of the jag that engage with the surface of the bore can be those outermost components such as cylinder 118, 218 and flanking ridges 112, 212.

In some embodiments, a top and bottom of cylinder 118, 218 is sloped or beveled toward the corresponding features above and below it. For example, cylinder 118, 218 may have a larger radius than spiked tip 104, 204, which is above the cylinder, and may have a larger radius than at least the topmost portion of central body 102, 202, which is below the cylinder. Therefore, a top of cylinder 118, 218 may be beveled inward toward cylindrical length 122, 222 and, more specifically, toward valley 126, 226 of the cylindrical length, and a bottom of the cylinder may be beveled inward toward central body 102, 202 and, more specifically, toward the uppermost deep reservoir 110, 210 of the central body.

In some embodiments, spiked tip 104 can attach to a patch, such as patch 300, illustrated in FIGS. 3-4. More specifically, a center portion of patch 300 can be connected to spiked tip 104 leaving equal portions of the patch on opposing sides of the spiked tip. Further, the equal portions of patch 300 can each have a length that is at least as long as central body 102 and a width that is approximately half the circumference of the widest point of the central body (for example, cylinder 118 and flanking ridges 112) such that the patch completely covers the central body. Therefore, the equal portions of patch 300 can each minimally overlap with each other along their lengths when inserted into a bore, as illustrated in FIG. 4. The helps to prevent loss of cleaning solvent as well as bunching or overlapping that would prevent proper cleaning.

Similarly, the second embodiment of the jag may also attach to a patch, such as patch 500, illustrated in FIGS. 5-6. As with the first embodiment, a center portion of patch 500 can attach to spiked tip 204 leaving equal portions on opposing sides of the spiked tip, and the equal portions can each be as long as central body 202 and have a width that is approximately half the circumference of the widest point of the central body (for example, cylinder 218 and flanking ridges 212) such that the patch completely covers the central body. Therefore, the equal portions of patch 500 can each minimally overlap with each other along their lengths when inserted into a bore, as illustrated in FIG. 6. Patches 300, 500 may be quilted, may include micro-pore fibers, and may be made of natural and/or synthetic materials.

In some embodiments, threaded portion 106, 206 can be in line with central body 102, 202 along axis Y and can have a radius that is similar to the radius of at least one deep reservoir 110, 210, or the radius of central portion 114, 214 or flanking ridges 112, 212 of at least one shallow reservoir 108, 208. Alternatively, threaded portion 106, 206 may have a radius different from the radius of any of deep reservoir 110, 210, flanking ridges 112, 212, or central portion 114, 214. The length of threaded portion 106, 206 may be larger than its width (or diameter). As mentioned above, central body 102, 202 may end with deep reservoir 110, 210 and, therefore, threaded portion 106, 206 may connect to the last deep reservoir (or, alternatively, may connect to a portion of shallow reservoir 108, 208, such as flanking ridge 112, 212).

Alternatively, jag 100, 200 may include stopper 116, 216, which can be positioned between the end of central body 102, 202 and threaded portion 106, 206, as illustrated in FIGS. 1 and 2. Stopper 116, 216 can have a larger radius than threaded portion 106, 206 such that any extension attached to jag 100, 200 via threading, may be prevented from moving past the threaded portion and into central body 102, 202, as illustrated in FIGS. 4 and 6. For example, jag 100, 200 can connect to elongate rod 400, 600 at threaded portion 106, 206.

The various embodiments described above are provided by way of illustration only and should not be construed to limit the claims attached hereto. Those skilled in the art will readily recognize various modifications and changes that may be made without following the example embodiments and applications illustrated and described herein and without departing from the true spirit and scope of the following claims.

What is claimed is:

1. A bore cleaning tool for cleaning the bore of a firearm barrel, comprising:

a jag having a central body having a plurality of shallow reservoirs which extend around a circumference of the central body and a plurality of deep reservoirs, wherein the plurality of shallow and deep reservoirs repeatedly alternate, and wherein each of the shallow reservoirs includes a pair of flanking ridges with a corresponding central portion, and each pair of flanking ridges has a larger radius than a radius of the corresponding central portion;

a spiked tip near a first end of the central body, wherein the spiked tip is comprised of a conical point and a cylindrical length, the cylindrical length having a series of ridges and valleys between the conical point and the central body; and a threaded portion near a second end of the central body.

2. The bore cleaning tool of claim 1, wherein the deep reservoirs each have identical lengths such that the shallow reservoirs are spaced equidistantly apart.

3. The bore cleaning tool of claim 1, wherein the shallow reservoirs each have identical lengths such that the deep reservoirs are spaced equidistantly apart.

4. The bore cleaning tool of claim 1, wherein the plurality of shallow reservoirs and deep reservoirs are approximately cylindrical, the radius of each pair of flanking ridges is uniform, the radius of each of the plurality of corresponding central portions is uniform, and the radius of each of the plurality of deep reservoirs is uniform.

5. The bore cleaning tool of claim 4, wherein the radius of each of the plurality of corresponding central portions is larger than the radius of each of the plurality of deep reservoirs.

6. The bore cleaning tool of claim 4, wherein the central body includes at least 7 shallow reservoirs and at least 7 deep reservoirs.

7. The bore cleaning tool of claim 4, wherein the central body includes 14 shallow reservoirs and 15 deep reservoirs.

8. The bore cleaning tool of claim 1, wherein the apparatus is connectable to an elongate rod at the threaded portion.

9. The bore cleaning tool of claim 8, the jag further comprising a stopper positioned between the second end of the central body and the threaded portion, wherein the stopper has a larger radius than a radius of the threaded portion, and wherein the threaded portion has a radius that is approximately the same as a radius of the plurality of deep reservoirs.

10. The bore cleaning tool of claim 1, further comprising a patch connected to the spiked tip.

11. The bore cleaning tool of claim 10, wherein a center of the patch is connected to the spiked tip leaving equal portions of the patch on opposing sides of the spiked tip, wherein the equal portions each have a length that is at least as long as the central body and a width that is approximately half the circumference of the flanking ridges.

12. The bore cleaning tool of claim 11, wherein the patch is quilted and includes micro-pore fibers.

13. The bore cleaning tool of claim 1, the jag further comprising a smooth, uniform cylinder between the spiked tip and the central body, the smooth, uniform cylinder having a similar radius to the radius of the flanking ridges of the shallow reservoirs.

14. The bore cleaning tool of claim 13, wherein the series of ridges and valleys is located between the spiked tip and the smooth, uniform cylinder.

15. The bore cleaning tool of claim 1, wherein the firearm cleaning apparatus is made of a single material.

16. The bore cleaning tool of claim 15, wherein the firearm cleaning apparatus is nickel plated.

17. The bore cleaning tool of claim 16, wherein the firearm cleaning apparatus is electroplated nickel.

18. A bore cleaning tool for cleaning the bore of a firearm barrel, comprising:

a jag having a central body having a plurality of cylindrical shallow reservoirs which extend around a circumference of the central body and a plurality of deep reservoirs, wherein the plurality of shallow and deep reservoirs repeatedly alternate, wherein the deep reservoirs each have identical lengths such that the shallow reservoirs are spaced equidistantly from one another, and wherein each of the shallow reservoirs includes a pair of flanking ridges with a corresponding central portion, and each of the pairs of flanking ridges have a larger radius than the corresponding central portion;

a spiked tip near a first end, wherein the spiked tip is comprised of a conical point and a cylindrical length, the cylindrical length having a series of ridges and valleys between the conical point and the central body;

a smooth, uniform cylinder between the spiked tip and the central body; and a threaded portion near a second end that is connectable to an elongate rod, wherein the jag is nickel plated.

19. The bore cleaning tool of claim 18, further comprising a quilted patch that is centered at the spiked tip and that covers the central body.

* * * * *